US007006601B2

(12) United States Patent
Suzuki et al.

(10) Patent No.: US 7,006,601 B2
(45) Date of Patent: Feb. 28, 2006

(54) X-RAY SOURCE

(75) Inventors: Kazutaka Suzuki, Hamamatsu (JP); Michihiro Ito, Hamamatsu (JP); Takatoshi Yoshiyama, Hamamatsu (JP); Hiroki Kawakami, Hamamatsu (JP); Tutomu Inazuru, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/786,619

(22) Filed: Feb. 26, 2004

(65) Prior Publication Data

US 2005/0190883 A1 Sep. 1, 2005

(51) Int. Cl.
*H05G 1/10* (2006.01)

(52) U.S. Cl. ..... 378/101; 378/119; 436/606; 436/276; 436/936

(58) Field of Classification Search ..... 378/101, 378/119, 199–203, 117, 193, 121; 439/606, 439/276, 936
See application file for complete search history.

(56) References Cited

U.S. PATENT DOCUMENTS

| | | | | |
|---|---|---|---|---|
| 4,646,338 A | | 2/1987 | Skillicorn | |
| 4,646,480 A | | 3/1987 | Williams | |
| 5,077,771 A | | 12/1991 | Skillicorn et al. | |
| 5,517,545 A | * | 5/1996 | Nakamura et al. | 378/101 |
| 6,490,341 B1 | * | 12/2002 | Ochiai et al. | 378/140 |
| 6,639,969 B1 | * | 10/2003 | Ochiai et al. | 378/119 |
| 6,860,092 B1 | * | 3/2005 | Collida et al. | 53/521 |
| 2002/0168050 A1 | * | 11/2002 | Ochiai et al. | 378/119 |

FOREIGN PATENT DOCUMENTS

| | | |
|---|---|---|
| JP | 58-14499 | 1/1983 |
| JP | 07-29532 | 1/1995 |
| JP | 11-224624 | 8/1999 |
| JP | 2001-135496 | 5/2001 |

* cited by examiner

*Primary Examiner*—Edward J. Glick
*Assistant Examiner*—Elizabeth Keaney
(74) *Attorney, Agent, or Firm*—Drinker Biddle & Reath LLP

(57) ABSTRACT

The present invention discloses an X-ray source comprising an X-ray tube including a target generating an X-ray in response to an electron beam incident thereon emitted from an electron gun and an X-ray exit window emitting thus generated X-ray; a power supply having a structure including an insulating block molding therein a voltage generating part supplying a voltage to the X-ray tube; a first planar member securing the X-ray tube while being arranged on one side of the insulating block; and a second planar member disposed on a side of the insulating block opposite from the first planar member. The first and second planar members are fastened to each other while holding the insulating block therebetween.

8 Claims, 4 Drawing Sheets

X-RAY SOURCE

BACKGROUND OF THE INVENTION

1. Field of the Invention

The present invention relates to an X-ray source in which an X-ray tube and its power supply are integrated with each other.

2. Related Background Art

A nondestructive inspection system for observing the internal structure of a sample as a fluoroscopic image without destroying the sample uses an X-ray generator incorporating therein an X-ray tube for irradiating the sample with an X-ray, an X-ray imaging apparatus (XI) detecting the X-ray transmitted through the sample, etc.

As the X-ray source of the X-ray generating apparatus, one in which an X-ray tube and its power supply are integrated with each other has conventionally been known in general (see, for example, Japanese Patent Application Laid-Open No. 2001-135496). As such a kind of integrated X-ray source, the X-ray source A shown in FIG. 1 has conventionally been known in general.

The X-ray source A shown in FIG. 1 comprises a power supply B in which a high-voltage generating part B2, a high-voltage line B3, a socket B4, etc. are molded in an insulating block B1 made of an epoxy resin; and an X-ray tube C incorporated therein such that a bulb part C1 is dipped into a high-voltage insulating oil B6 in a reservoir recess B5 formed in the insulating block B1.

Fixed onto the surface of the insulating block B1 on the side where the reservoir recess B5 opens in the power supply B is a shield plate B7 securing the X-ray tube C and covering the opening of the reservoir recess B5. A bottom plate B8 is secured to the opposite surface of the insulating block B1. The shield plate B8 is formed with an opening B9 through which the bulb part C1 of the X-ray tube C is inserted, whereas an attachment flange C2 of the X-ray tube C is secured to the surroundings of the opening B9.

The X-ray tube C comprises the bulb part C1 accommodating therein a support member C3 (having a target), an X-ray generating part C5 containing a target C4 at the leading end part of the support member C3 (having the target), and an electron gun part C6 accommodating an electron gun which emits an electron beam to the target C4. The X-ray generating part C5 is arranged concentrically with the bulb part C1 on the opposite side of the attachment flange C2 from the bulb part C1, whereas the axis of the electron gun part C6 is orthogonal to the axis of the X-ray generating part C5 and bulb part C1.

Such an X-ray tube C is constructed so as to receive a high voltage from the high-voltage generating part B2 of the power supply B by way of the high-voltage line B3 when a high-voltage applying part C7 at the base end part of the support member C3 (having the target) projecting from the bulb part C1 fits into the socket B4 molded in the insulating block B1 of the power supply B.

In the conventional X-ray source A shown in FIG. 1, the shield plate B7 and bottom plate B8 are secured to the insulating block B1, which is made of the epoxy resin, with a plurality of securing screws B10. As the structure therefor, a plurality of female-threaded tubes B11 to mate with the respective securing screws B10 are buried in the insulating block B1.

It has been considered problematic that, if the female-threaded tubes B11 buried in the insulating block B1 and the securing screws B10 screwed therein are made of a metal, they become conductive foreign matters and induce discharges when the high-voltage generating part B2 of the power supply B generates a high voltage. It has also been considered problematic that, if the female-threaded tubes B11 and securing screws B10 are made of a resin, they are charged when the high-voltage generating part B2 generates a high voltage, whereby disturbances are induced in electric fields.

SUMMARY OF THE INVENTION

It is therefore an object of the present invention to provide an X-ray source which can suppress useless discharge phenomena and disturbances in electric fields.

The present invention provides an X-ray source comprising an X-ray tube including a target generating an X-ray in response to an electron beam incident thereon emitted from an electron gun and an X-ray exit window emitting thus generated X-ray; a power supply having a structure including an insulating block molding therein a voltage generating part supplying a voltage to the X-ray tube; a first planar member securing the X-ray tube while being arranged on one side of the insulating block; and a second planar member disposed on a side of the insulating block opposite from the first planar member; wherein the first and second planar members are fastened to each other while holding the insulating block therebetween.

The X-ray source in accordance with the present invention comprises a structure in which the insulating block of the power supply is held between the first and second planar members fastened to each other, so that neither conductive foreign matters inducing discharges and electrifiable foreign matters inducing disturbances in electric fields exist within the insulating block B, whereby useless discharge phenomena and disturbances in electric fields are suppressed in the power supply.

In the X-ray source of the present invention, it will be preferred if the surface of the insulating block is coated with conductive paint, because this allows the outer face of the power supply to attain the GND potential (ground potential).

DESCRIPTION OF THE PREFERRED EMBODIMENTS

In the following, embodiments of the X-ray source in accordance with the present invention will be explained with reference to the drawings. Among the drawings referred to, FIG. 2 is an exploded perspective view showing the overall structure of the X-ray source in accordance with a first embodiment, whereas FIG. 3 is a vertical sectional view showing the internal structure of the X-ray source in accordance with the first embodiment.

Figure 1:
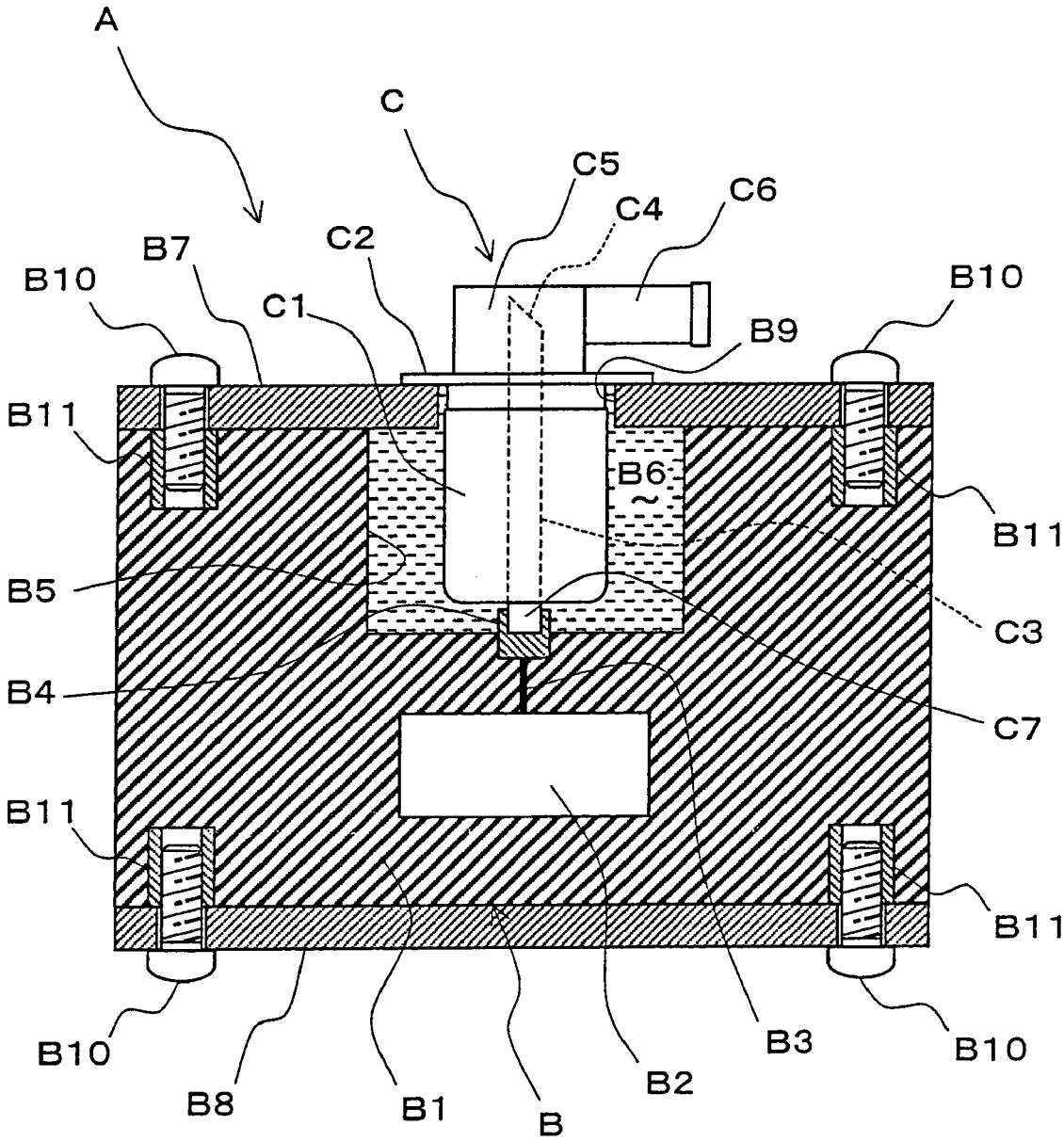
FIG. 1 is a vertical sectional view showing the internal structure of the X-ray source in accordance with a conventional example.
Figure 2:
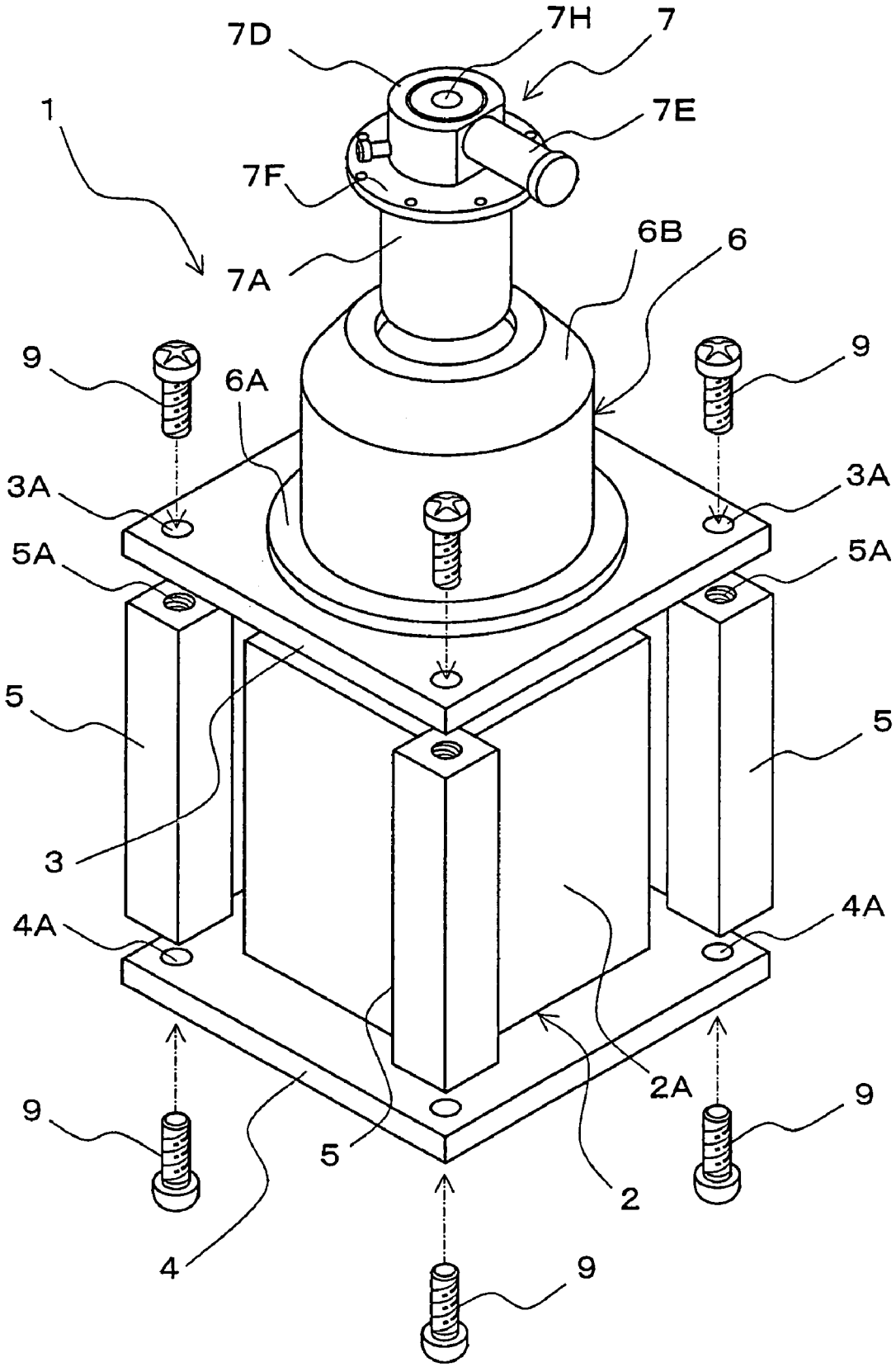
FIG. 2 is an exploded perspective view showing the overall structure of the X-ray source in accordance with a first embodiment of the present invention.
Figure 3:
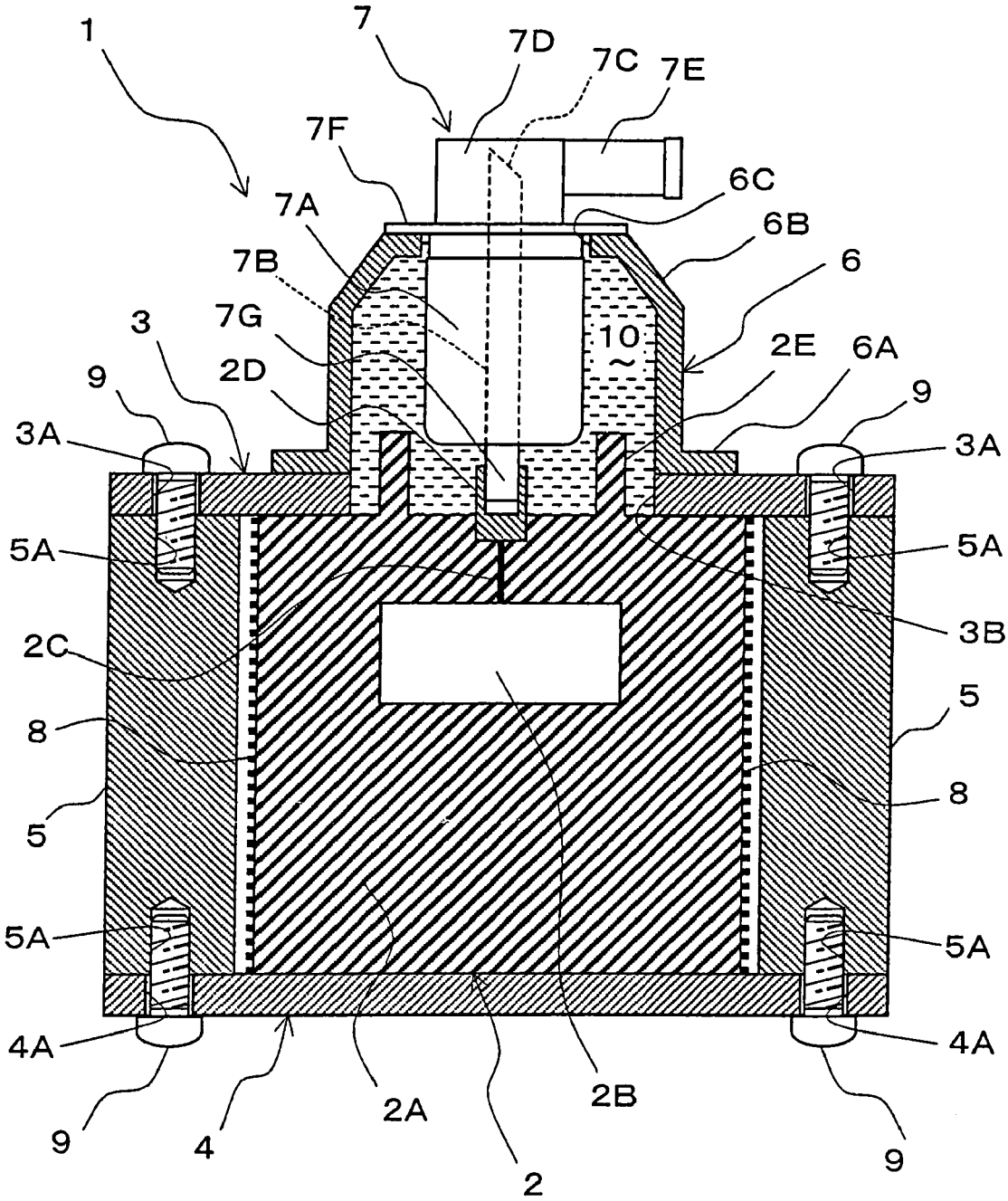
FIG. 3 is a vertical sectional view showing the internal structure of the X-ray source in accordance with the first embodiment.

As shown in FIGS. 2 and 3, the X-ray source 1 in accordance with the first embodiment comprises a power supply 2 having a structure in which a high-voltage generating part 2B, a high-voltage line 2C, a socket 2D, etc. (see FIG. 3) are molded in an insulating block 2A made of an epoxy resin; a first planer member 3 disposed on the upper face side of the insulating block 2A depicted on the upper face side in the drawing; a second planar member 4 disposed on the lower face side of the insulating block 2A; four fastening spacer members 5 interposed between the first planer member 3 and second planar member 4; and an X-ray tube 7 secured onto the first planar member 3 by way of a metallic tubular member 6.

The insulating block 2A of the power supply 2 is shaped like a rectangular column with substantially square upper and lower faces parallel to each other, whereas the cylindrical socket 2D connected to the high-voltage generating part 2B by way of the high-voltage line 2C is disposed at the center part of the upper face. An annular wall 2E arranged concentrically with the socket 2D projects from the upper face of the insulating block 2A. The peripheral face of the insulating block 2A is coated with conductive paint 8 for attaining the GND potential (ground potential).

The first planar member 3 and second planar member 4 are members cooperating with four fastening spacer members 5 and eight fastening screws 9, for example, so as to hold the insulating block 2A of the power supply 2 from the upper and lower sides in the drawing, and are shaped into substantially square forms greater than the upper and lower faces of the insulating block 2A, respectively. At the corners of the first planar member 3 and second planar member 4, screw insertion holes 3A, 4A for inserting the fastening screws 9 are formed. The first planar member 3 is formed with a circular opening 3B surrounding the annular wall 2E projecting from the upper face of the insulating block 2A.

The four fastening spacer members 5, each formed like a square column, are disposed at the corners of the first planer member 3 and second planar member 4. Each fastening spacer member 5 is slightly shorter than the gap between the upper and lower faces of the insulating block 2A, i.e., by the fastening margin of the insulating block 2A. The upper and lower end faces of each fastening spacer member 5 are formed with respective screw holes 5A into which a fastening screw 9 is screwed.

The metallic tubular member 6 is shaped like a cylinder, whereas an attachment flange 6A formed at the base end part thereof is secured to the surroundings of the opening 3B of the first planar member 3 by screwing by way of a seal member which is not depicted. At leading end corners of the metallic tubular member 6, a tapered flank 6B is formed. The leading end face of the metallic tubular member 6 is formed with an opening 6C through which a bulb part 7A of the X-ray tube 7 is inserted.

The X-ray tube 7 is a reflection type X-ray tube comprising the bulb part 7A holding and accommodating a support member 7B (having a target) while being insulated from the support member 7B, an X-ray generating part 7D containing a target 7C provided at the leading end part of the support member 7B, and an electron gun part 7E for emitting an electron beam to the target 7C.

The bulb part 7A and the X-ray generating part 7D are arranged concentrically, whereas their axis is substantially orthogonal to the axis of the electron gun part 7E. An attachment flange 7F to be secured to the leading end face of the metallic tubular member 6 is formed between the bulb part 7A and the X-ray generating part 7D. As a high-voltage applying part 7G, the base end part of the support member 7B (having the target) projects downward from the center part of the bulb part 7A (see FIG. 3).

The X-ray tube 7 is provided with an exhaust pipe which is not depicted, through which the bulb part 7A, the X-ray generating part 7D, and the electron gun part 7E are evacuated.

Such an X-ray tube 7 is constructed so as to receive a high voltage from the high-voltage generating part 2B by way of the high-voltage line 2C when the high-voltage applying part 7G fits into the socket 2D molded in the insulating block 2A of the power supply 2. When an electron gun (not depicted) built in the electron gun part 7E emits an electron beam to the target 7C in this state, an X-ray is generated in response to the electron beam incident on the target 7C and then is emitted from an X-ray exit window 7H attached to the opening of the X-ray generating part 7D.

The X-ray source 1 in accordance with the first embodiment is assembled by the following manner, for example. First, four fastening screws 9 inserted through their corresponding screw insertion holes 4A of the second planar member 4 are screwed into the respective screw holes 5A in the lower end faces of the four fastening spacer members 5. Subsequently, four fastening screws 9 inserted through their corresponding screw insertion holes 3A of the first planar member 3 are screwed into the respective screw holes 5A in the upper end faces of the four fastening spacer members 5, whereby the first planer member 3 and second planar member 4 are fastened to each other while holding the insulating block 2A from the upper and lower sides. Here, respective seal members are interposed between the first planer member 3 and the upper face of the insulating block 2A, and between the second planer member 4 and the lower face of the insulating block 2A.

Next, a high-voltage insulating oil 10 is injected as an insulating liquid material into the opening 6C of the metallic tubular member 6 secured onto the first planar member 3. Subsequently, the bulb part 7A of the X-ray tube 7 is inserted into the metallic tubular member 6 from the opening 6C thereof, so as to be dipped into the high-voltage insulating oil 10, whereby the high-voltage applying part 7G projecting downward from the center part of the bulb part 7A fits into the socket 2D on the power supply 2 side. Then, the attachment flange 7F of the X-ray tube 7 is secured to the leading end face of the metallic tubular member 6 by screwing by way of a seal member which is not depicted.

In thus assembled X-ray source 1 in accordance with the first embodiment, as shown in FIG. 3, the annular wall 2E projecting from the upper face of the insulating block 2A of the power supply 2 and the metallic tubular member 6 are arranged concentrically about the axis of the support member 7B (having the target) of the X-ray tube 7. The annular wall 2E surrounds the high-voltage applying part 7G protruded from the bulb part 7A of the X-ray tube 7, and projects by such a height as to shield the high-voltage applying part 7G from the metallic tubular member 6.

When a high voltage is applied to the high-voltage applying part 7G of the X-ray tube 7 from the high-voltage generating part 2B of the power supply 2 by way of the high-voltage line 2C and socket 2D in the X-ray source 1 in accordance with this embodiment, the target 7C is supplied with the high voltage by way of the support member 7B (having the target). When the electron gun (not depicted) incorporated in the electron gun part 7E of the X-ray tube 7 emits an electron beam to the target 7C accommodated in the X-ray generating part 7D in this state, an X-ray is generated in response to the electron beam incident on the target 7C and then is emitted from the X-ray exit window 7H attached to the opening of the X-ray generating part 7D.

The X-ray source 1 in accordance with the first embodiment comprises a structure in which the insulating block 2A of the power supply 2 is held between the first planar member 3 and second planar member 4 fastened to each other by way of the four fastening spacer members 5, whereas the inside of the insulating block 2A is free of conductive foreign matters inducing discharges and electrifiable foreign matters inducing disturbances in electric fields. Therefore, the X-ray source 1 in accordance with the first embodiment can suppress useless discharge phenomena and electric field disturbances in the power supply 2.

Since the peripheral face of the insulating block 2A is coated with the conductive paint 8, the outer face of the power supply 2 can easily attain the GND potential.

Since the metallic tubular member 6 for dipping the bulb part 7A of the X-ray tube 7 into the high-voltage insulating oil 10 in order to keep the resistance to voltage projects upward from the first planar member 3, its thermal dissipation characteristic is favorable, whereby the dissipation of heat from the high-voltage insulating oil 10 and the bulb part 7A of the X-ray tube 7 within the metallic tubular member 6 can be accelerated.

The metallic tubular member 6 is formed like a cylinder about the support member 7B (having the target), so as to keep the same distance from the support member 7B (having the target), and thus can stabilize electric fields formed about the support member 7B (having the target). This metallic tubular member 6 can effectively cause the charged high-voltage insulating oil 10 to discharge.

Since the annular wall 2E projecting from the upper face of the insulating block 2A of the power supply 2 surrounds the high-voltage applying part 7G projecting from the bulb part 7A of the X-ray tube 7 and shields it from the metallic tubular member 6, abnormal discharges from the high-voltage applying part 7G to the metallic tubular member 6 can effectively be prevented from occurring.

Figure 4:
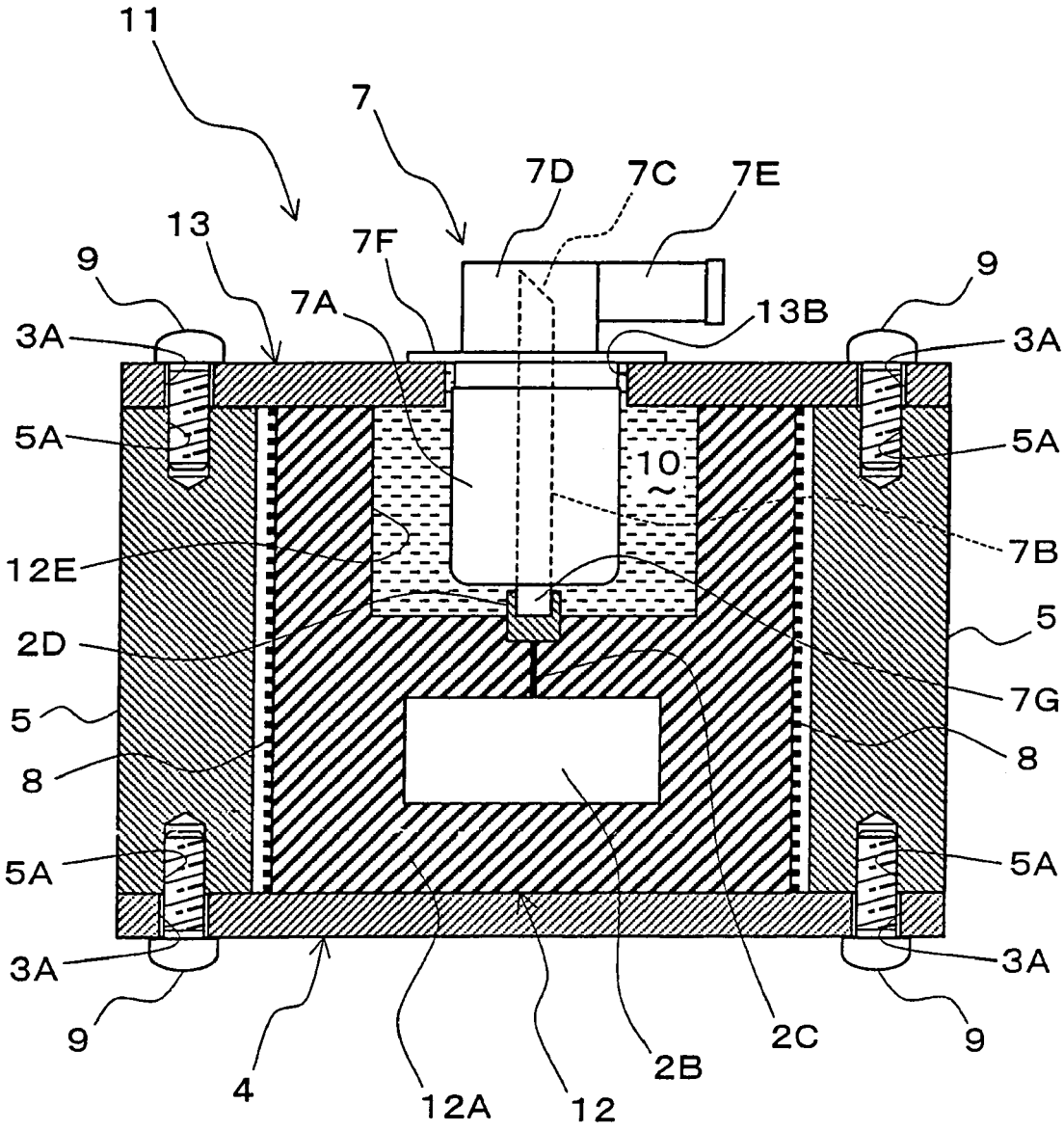
FIG. 4 is a vertical sectional view showing the internal structure of the X-ray source in accordance with a second embodiment.

With reference to FIG. 4, the X-ray source 11 in accordance with a second embodiment will now be explained. The X-ray source 11 in accordance with the second embodiment greatly differs from the structure of the X-ray source 1 in accordance with the first embodiment in that the above-mentioned metallic tubular member 6 is not provided, whereas forms of the insulating block 12A and first planar member 13 corresponding to the insulating block 2A and first planar member 3 mentioned above are slightly changed in connection therewith. The other structural parts in the X-ray source 11 in accordance with the second embodiment are configured as with those in the X-ray source 1 in accordance with the first embodiment, and thus will be referred to with numerals identical to those in the X-ray source 1 in accordance with the first embodiment without repeating their overlapping explanations.

In the X-ray source 11 in accordance with the second embodiment, the upper face of the insulating block 12A in the power supply 12 is formed with a reservoir recess 12E for storing the high-pressure insulating oil 10, whereas the socket 2D is disposed at the center part of the flat bottom part of the reservoir recess 12E.

The first planar member 13 is formed with an opening 13B for inserting the bulb part 7A of the X-ray tube 7 therethrough instead of the opening 3B of the first planar member 3.

The bulb part 7A of the X-ray tube 7 is dipped into the high-voltage insulating oil 10 in the reservoir recess 12E through the opening 13B of the first planar member 13, whereas the high-voltage applying part 7G projecting from the bulb part 7A fits into the socket 2D projecting from the bottom part of the reservoir recess 12E. The attachment flange 7F of the X-ray tube 7 is secured to the surroundings of the opening 13B of the first planar member 13 by screwing by way of a seal member which is not depicted.

Thus configured X-ray source 11 in accordance with the second embodiment comprises a structure in which the first planar member 13 and second planar member 4 fastened to each other by way of four fastening spacer members 5 hold the insulating block 12A of the power supply 12 therebetween, whereby neither conductive foreign matters inducing discharges nor electrifiable foreign matters inducing disturbances in electric fields exist within the insulating block 12A. Therefore, the X-ray source 11 in accordance with the second embodiment can suppress useless discharge phenomena and disturbances in electric fields in the power supply 12.

Since the peripheral face of the insulating block 12A is coated with the conductive paint 8, the outer face of the power supply 12 can easily attain the GND potential.

The X-ray source in accordance with the present invention is not limited to the first and second embodiments. For example, the insulating block 2A, 12A of the power supply 2, 12 may be formed like a cylindrical column, and the first planar member 3, 13 and second planar member 4 may be formed like disks correspondingly. The fastening spacer members 5 may be formed like cylindrical columns, whereas their number is not limited to 4.

The X-ray tube 7 may have a structure in which an electron gun is disposed within the bulb part 7A.

As explained in the foregoing, the X-ray source in accordance with the present invention comprises a structure in which an insulating block of a power supply is held between first and second planar members fastened to each other, so that neither conductive foreign matters inducing discharges nor electrifiable foreign matters inducing disturbances in electric fields exist within the insulating block, whereby useless discharge phenomena and disturbances in electric fields can be suppressed in the power supply.

What is claimed is:

1. An X-ray source comprising:

an X-ray tube including a target generating an X-ray in response to an electron beam incident thereon emitted from an electron gun and an X-ray exit window emitting thus generated X-ray;

a power supply having a structure including an insulating block molding therein a voltage generating part supplying a voltage to the X-ray tube;

a first planar member securing the X-ray tube and arranged on a first side of the insulating block; and a second planar member disposed on a second side of the insulating block which is substantially parallel with the first side of the insulating block, the second planar member being separately disposed from the first planar member;

the first and second planar members holding the insulating block in place by sandwiching the insulating block there between at its first and second sides without providing any fastening member in the insulating block.

2. An X-ray source according to claim 1, wherein the insulating block has a surface covered with conductive material.

3. An X-ray source comprising:

an X-ray tube including a target generating an X-ray in response to an electron beam incident thereon emitted from an electron gun and an X-ray exit window emitting thus generated X-ray;

a power supply having a structure including an insulating block molding therein a voltage generating part supplying a voltage to the X-ray tube;

a first planar member securing the X-ray tube and arranged on a first side of the insulating block; and a second planar member disposed on a second side of the insulating block which is substantially parallel with the first side of the insulating block, the second planar member being separately disposed from the first planar member;

the first and second planar members holding the insulating block in place by sandwiching the insulating block there between at its first and second sides without providing any fastening member in the insulating block, the first and second planar members being fastened to each other via one or more spacer members provided separately from the insulating block.

4. An X-ray source according to claim 3, wherein the insulating block has a surface covered with conductive material.

5. An X-ray source according to claim 3, wherein a plurality of the spacer members are arranged around the insulating block and the spacer members are fastened to the first and second planar members with fastening members.

6. An X-ray source according to claim 3, wherein the first and second planar members are fixed to the one or more spacer members by engagement of one or more screw and screw hole combinations, the screw and the screw hole combination extending in a direction crossing main surface planes of the first and second planar members so that the insulating block is sandwiched and rigidly held by both of the first and second planar members in combination.

7. An X-ray source according to claim 3, wherein the insulating block has first and second planes which are substantially parallel with each other, the first planar member contacts the first plane of the insulating block, the second planar member contacts the second plane of the insulating block, a length of the spacer member is shorter than the distance between the first and second planes of the insulating block.

8. An X-ray source according to claim 3, wherein a plurality of the spacer members are arranged between the first and second planar members, the spacer members being spaced with a predetermined distance therebetween among them.

* * * * *